US005379886A

United States Patent [19]

Brauner et al.

[11] Patent Number: 5,379,886

[45] Date of Patent: Jan. 10, 1995

[54] PACKAGE INCLUDING A SEPARATELY FORMED PREMIUM TRAY

[75] Inventors: Arne H. Brauner, Minnetonka; Stuart N. Bernard, Anoka; Francis M. Snee, Brooklyn Park, all of Minn.

[73] Assignee: General Mills, Inc., Minneapolis, Minn.

[21] Appl. No.: 155,893

[22] Filed: Nov. 23, 1993

[51] Int. Cl.[6] ..... B65D 77/00

[52] U.S. Cl. ..... 206/216; 206/45.31; 206/462; 229/103.1; 53/167

[58] Field of Search ..... 206/45.31, 216, 459.5, 206/461, 462, 467; 229/103.1, 120.03, 162, 1.5 C; 220/506, 521, 528, 661, 735, 736; 53/167

[56] References Cited

U.S. PATENT DOCUMENTS

| | | | |
|---|---|---|---|
| 1,344,664 | 6/1920 | Wander | 206/216 |
| 2,153,911 | 4/1939 | Benedetti | 206/45.31 |
| 2,209,200 | 7/1940 | Hanson . | |
| 2,532,857 | 12/1950 | Ricciardi . | |
| 2,643,811 | 6/1953 | Bolding . | |
| 2,784,539 | 3/1957 | Silver | 206/462 |
| 3,207,411 | 9/1965 | Farquhar . | |
| 3,240,415 | 3/1966 | Pugh, Sr. | 229/103.1 |
| 3,369,660 | 2/1968 | Hartman | 206/462 |
| 3,387,762 | 6/1968 | Zupon . | |
| 3,389,850 | 6/1968 | Rockefeller . | |
| 3,399,763 | 9/1968 | Stone | 206/462 |
| 3,526,351 | 9/1970 | Goldstein . | |
| 3,587,848 | 6/1971 | Froehlig | 206/462 |
| 3,679,093 | 7/1972 | Chang | 229/103.1 |
| 3,874,554 | 4/1975 | Chang | 229/103.1 |
| 4,840,275 | 6/1989 | Faiola et al. | 206/462 |
| 4,930,637 | 6/1990 | DeRoseau | 229/1.5 C |
| 4,962,856 | 10/1990 | Carter | 206/459.5 |
| 4,964,512 | 10/1990 | Ingram et al. | 206/459.5 |
| 4,969,595 | 11/1990 | Teasdale | 206/459.5 |
| 5,012,972 | 5/1991 | Nordstrom et al. . | |
| 5,021,274 | 6/1991 | Beck et al. | 206/459.5 |
| 5,193,671 | 3/1993 | Patterson . | |

FOREIGN PATENT DOCUMENTS

| | | | |
|---|---|---|---|
| 1124150 | 6/1956 | France | 206/462 |

*Primary Examiner*—David T. Fidei

*Attorney, Agent, or Firm*—L. MeRoy Lillehaugen; John A. O'Toole; Alan D. Kamrath

[57] ABSTRACT

A package (10) is disclosed including a tray (22) having an annular flange (34) extending from the open end (26) of a basket (24) receiving a promotional device (38). The open end (26) of the basket (24) is closed by a clear membrane label (32) extending thereover and onto the flange (34) to seal the promotional device (38) in the basket (24). The basket (24) is inserted into an opening (20) formed in a panel (14) of a carton (12) until the flange (34) abuts with the panel (14) around the opening (20). A second label (36) is secured over the tray (22) and to the panel (14) around the flange (34) to attach the tray (22) to the carton (12). To temporarily lock the tray (22) to the carton (12) prior to the securement of the second label (36), the basket (24) can be friction fit in the opening (20), can include detents (40) formed in the side walls (28) of the basket (24) for abutting with the panel (14) opposite to the flange (34), or the like.

21 Claims, 1 Drawing Sheet

PACKAGE INCLUDING A SEPARATELY FORMED PREMIUM TRAY

BACKGROUND

The present invention generally relates to packaging, particularly relates to packaging including a premium, and specifically relates to packaging including a separately formed tray for receipt of a promotional premium in the sale of products such as cereal.

Due to the fierce competition in the marketing of breakfast cereals, it is the practice of many cereal manufacturers to include a premium with the cereal to promote the sale of the cereal beyond the marketability of the cereal itself. It can certainly be appreciated that such promotional devices must meet several requirements. First, as such devices are typically given away with the product, such devices must be relatively inexpensive to manufacture. Additionally, such devices must have the ability to be easily included with the product without disruption of the normal handling of such product. Thus, it is desirable that the promotional device be includable with the product without requiring different boxes, cartons, or the like, which would increase the cost of product production. Similarly, the promotional device should not require special handling or care by the manufacturer and retailer of the product beyond that normally given the product without the promotional device. But most important, the promotional device should have consumer appeal to maximize the promotional value of the device.

Promotional devices include items like coupons, toys, novelty items, or the like which are placed in the boxes of the product. It can then be appreciated that the promotional device is hidden inside the box and often access to the promotional device can occur only after consumption of most, if not all, of the product. Thus, the promotional value is reduced in that only facsimile representations of the promotional device are available at the time of purchase and customer enjoyment of the promotional device is delayed. This is also disadvantageous for other reasons. First, as the premium can not be seen from the outside of the box, it is impossible for the manufacturer to verify that a promotional device is actually present and has not been omitted from any particular box without opening the box and thus destroying its marketability. Omission of the promotional device results in customer dissatisfaction and may actually reduce the marketability of the product. Additionally, to promote the sale of the product and as the customer can not see the promotional device, the outside of the box includes printing advertising the existence of the promotional device. Thus, it is necessary to inventory a variety of different cartons with different graphics corresponding to the promotion devices intended to be utilized. In addition to the extra inventory costs, it can be appreciated that this is very inflexible in the ability to change the promotional device because of unavailability or changing market conditions, for example.

It is thus an object of the present invention to provide packaging which exposes a promotional device separately from the sale of a product, and especially cereal.

Yet another object of the present invention is to provide such novel packaging wherein the promotional device can be added after the product has been placed in the box.

It is still further an object of the present invention to provide such novel packaging wherein the promotional device of a variety of types can be added to a generic box.

Still another object of the present invention is to allow a promotional device to be added at the end of the production line or off-line at an alternate site to the product manufactured in a conventional manner.

In yet another object of the present invention, the promotional device is viewable from the outside of the carton for the product.

In still another object of the present invention, access to the promotional device is allowed without requiring consumption of all or part of the product within the carton.

SUMMARY

Surprisingly, these objects and other aims can be satisfied in the field of promotional devices in the sale of products by providing, in the most preferred form, a method for packaging and a package wherein a basket of a tray is inserted into an opening formed in a panel of the carton until a flange extending from the open end of the basket abuts with the panel outside of the opening, with the promotional device being received in the basket. A label is secured over the tray and to the panel outside of the opening and the flange for retaining the tray to the panel, with a separate label being provided in the most preferred form for retaining the promotional device in the basket.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figures 1, 2:
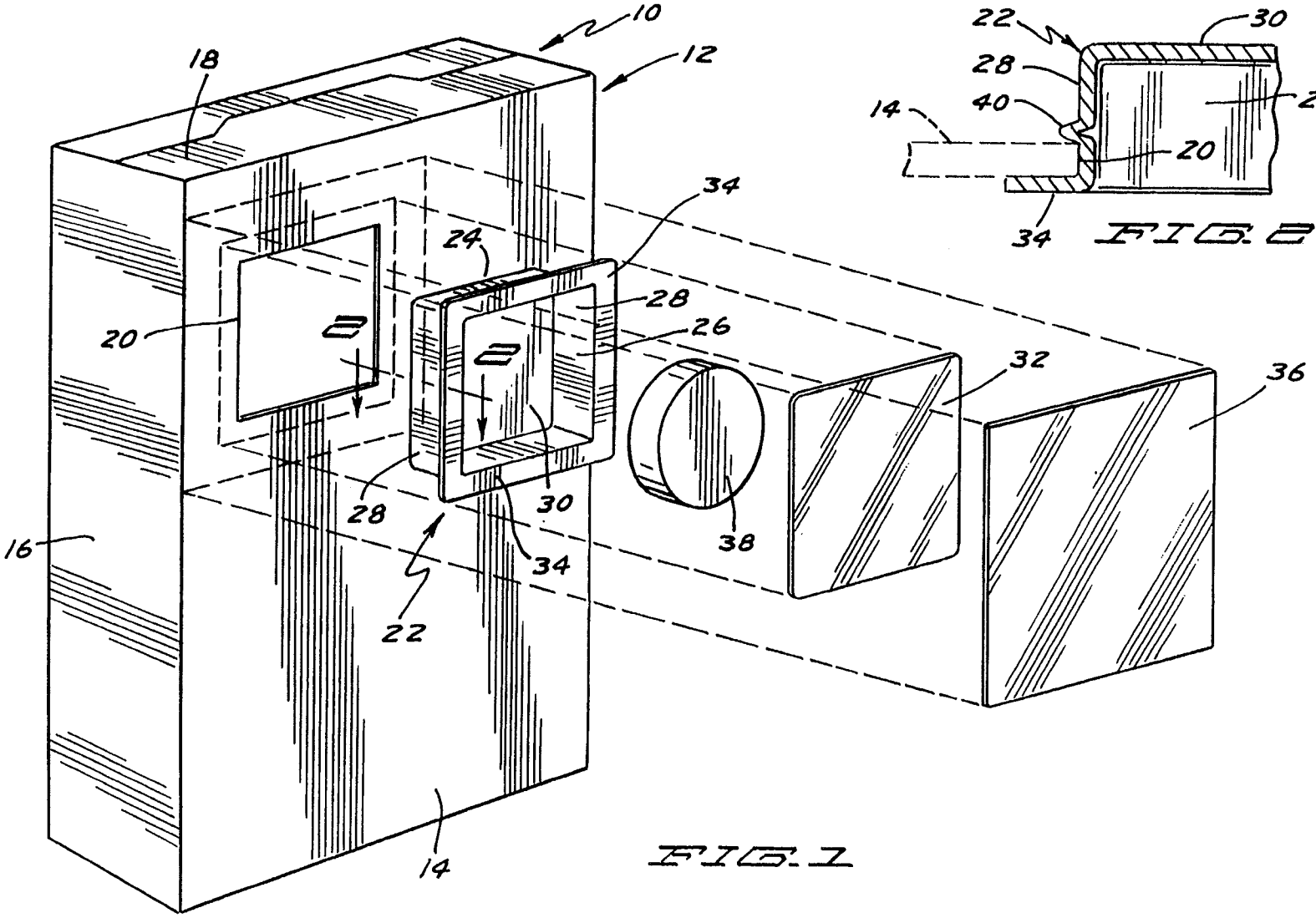
FIG. 1 shows an exploded perspective view of a package including a separately formed premium tray according to the preferred teachings of the present invention.
FIG. 2 shows a cross-sectional view of the premium tray of FIG. 1 according to section line 2—2 of FIG. 1.

All Figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will Likewise be within the skill of the art after the following teachings of the present invention have been read and understood.

Where used in the various Figures of the drawings, the same numerals designate the same or similar parts. Furthermore, when the terms "top", "bottom", "first", "second", "inside", "outside", "front", "back", "outer", "inner", "upper", "lower", "height", "width", "length", "end", "side", and similar terms are used herein, it should be understood that these terms have reference only to the structure shown in the drawings as it would appear to a person viewing the drawings and are utilized only to facilitate describing the invention.

DESCRIPTION

A package according to the preferred teachings of the present invention is shown in the drawings and generally designated 10. Generally, package 10 includes an outer carton or box 12 and an inner liner for holding the product such as read-to-eat breakfast cereal to be marketed. The liner can be formed of any suitable material such as glassine, wax paper, or plastic, and can be formed in any suitable manner as is well known in the art. The typical shape of carton 12 is a rectangular parallelepiped having large face panels 14, side panels 16, and top and bottom panels 18. Typically, carton 12 is formed of a single layer of generally stiff material such as cylinder grade, multi-ply paperboard. However, it can be appreciated that carton 12 can have other shapes and can be formed of other materials. Likewise, package 10 can be utilized to market other types and kinds of products as is well known in the art.

Carton 12 according to the preferred teachings of the present invention includes an opening 20 formed in at least one of panels 14, 16, and 18 and typically panel 14 such as by die cutting. Opening 20 can have any desired size and shape such as square as shown.

Package 10 according to the teachings of the present invention further includes a tray 22. Tray 22 generally includes a basket 24 which is generally closed except for an open end 26. In the preferred form shown, basket 24 is in the shape of a rectangular parallelepiped including four flat side walls 28 extending generally perpendicular from open end 26 and a flat bottom wall 30 extending generally perpendicular to side walls 28 and parallel to and spaced from open end 26. It can then be appreciated that basket 24 can have other shapes such as semispherical or portions thereof. Tray 22 further includes an annular flange 34 extending around and from open end 26. Tray 22 in the most preferred form includes a clear membrane label 32 of a size slightly smaller than and for adherance to flange 34 and extending over and closing open end 26, with label 32 being parallel to and spaced from bottom wall 30 in the most preferred form. Basket 24 has a depth which is substantially larger than the thickness of panel 14, 16, or 18 including opening 20 in the most preferred form. Further, cross sections of basket 24 parallel to flange 34 are of a size equal to or smaller than opening 20, with the cross sections of basket 24 adjacent to flange 34 being of a size and shape generally equal to and for slideable receipt in opening 20 in the preferred form. In the most preferred form, basket 24 and flange 34 of tray 22 are formed of opaque material such as thermoformed plastic.

Package 10 according to the preferred teachings of the present invention further includes a second, adhesive label 36 of a size larger than flange 34 of tray 22. In the most preferred form, label 36 is formed of a clear, transparent membrane having an adhesive located on one side at least around the periphery thereof. Label 36 further can include copy printed thereon such as identifying and/or advertising the particular promotional device 38 to be included with the product. Copy can be printed alternately on label 32 or on both labels 32 and 36, if desired. Device 38 which is only diagramatically shown is preferably of a size to fit totally within basket 24 of tray 22 and specifically is not of a size to extend through or protrude from open end 26 of basket 24 of tray 22.

Now that the basic construction of package 10 according to the preferred teachings of the present invention has been explained, a preferred manner of manufacture and further features thereof can be set forth and appreciated. Specifically, carton 12 can be set up, the setup carton 12 filled with suitable product such as ready-to-eat breakfast cereal contained in a liner, and top and bottom panels 18 folded and sealed in a conventional manner, aside from carton 12 including opening 20. Thus, package 10 according to the teachings of the present invention does not interfere with the current production set-up for the product. At the end of the production line or even off-line at an alternate site, tray 22 is positioned such that basket 24 extends through opening 20 and flange 34 abuts with panel 14, 16, or 18 around opening 20. In the most preferred form, tray 22 including device 38 retained therein by label 32 is preformed as a separately assembled unit. Thus, promotional device 38 is sealed and effectively enclosed at all sides by basket 24 and label 32 in tray 22. Label 36 can then be positioned to adhere or be otherwise secured at least to panel 14, 16, or 18 around the entire periphery of flange 34 and overlies flange 34, label 32, and open end 26. This, label 36 retains tray 22 relative to carton 12 with basket 24 positioned in opening 20 and also further captures promotional device 38 within basket 24 of tray 22. It can then be appreciated that after purchase, the consumer can either puncture labels 32 and 36 or tear off labels 32 and 36 for access to and removal of promotional device 38 from basket 24.

In the most preferred form of the present invention and to assist in the assembly of package 10, suitable provisions are provided to temporarily lock tray 22 in opening 20 before label 36 is applied to prevent tray 22 from separating from carton 12 while carton 12 and tray 22 are moved along the production line towards the application position of label 36. In a first preferred form, tray 22 includes semispherical bosses or detents 40 formed in one or more of side walls 28 and spaced from and extending parallel to flange 34 a distance for receipt of a thickness of panel 14, 16, or 18 extending around opening 20. It can then be appreciated that detents 40 generally allow movement into opening 20 to be positioned on the opposite side of panel 14, 16, or 18 than flange 34 but abut with the opposite side of panel 14, 16, or 18 after insertion and when tray 22 is attempted to be withdrawn from opening 20. However, it can be appreciated that label 36 is relied upon as the primary method of retention of tray 22 in opening 20 in the final commercial form of package 10. Thus, detents 40 need not be of an elaborate structure which would increase the overall cost of tray 22 according to the preferred teachings of the present invention. Similarly, the use of a friction-fit between side walls 28 of tray 22 adjacent flange 34 and opening 20 can be utilized to temporarily lock tray 22 in opening 20 before application of label 36, with label 36 again being relied upon as the primary method of retention of tray 22 in opening 20 in the final commercial form of package 10.

It can then be appreciated that basket 24 can hold a variety of different kinds and types of promotional devices 38. Additionally, labels 32 and/or 36 can include copy identifying and/or advertising the particular type or kind of promotional device 38 located in basket 24. It can then be appreciated that carton 12 can be of a generic variety which does not identify whether or not a promotional device 38 is included, and only those cartons 12 in which a promotional device 38 is desired to be included having opening 20 die cut or otherwise formed therein. Similarly, carton 12 could identify and- /or advertise that a promotional device 38 is present but not identify and/or advertise the particular type or kind of promotional device 38 located in basket 24. Thus, the inventory requirements for carton 12 can be reduced. Additionally, package 10 according to the preferred teachings of the president invention has the ability to rapidly change the type or kind of promotional device 38 to be included due to unavailability or changing market conditions, for example. In the most preferred form, labels 32 and/or 36 include copy printed thereon, which copy could identify and/or advertise the particular type or kind of promotional device 38 contained in basket 24.

In the most preferred form, at least portions of labels 32 and 36 positioned over open end 26 of basket 24 are transparent and allow viewing of promotional device 38 located in basket 24 therethrough. Due to the opaque nature of basket 24, it is not possible to view the interior of carton 12 through opening 20 which would be a distraction to promotional device 38 that tray 22 is intended to feature. Thus, the promotional value of device 38 is enhanced since the consumer can actually view device 38 before purchasing the product and can have immediate accessibility to device 38 without requiring consumption of all or part of the product included within carton 12. This advantage is especially important for young consumers having no or limited ability to read. Further, the manufacturer of package 10 according to the preferred teachings of the present invention can verify, without destroying the marketability of package 10, that each package 10 has a promotional device 38 and that it was not omitted, thus reducing customer dissatisfaction.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed

1. Package for a product and a promotional device comprising, in combination: a carton containing the product and including at least one panel having a thickness; an opening formed in the panel of the carton; a tray including a basket and a flange, with the basket having an open end and a depth substantially larger than the thickness of the panel and of a size for receipt into the opening formed in the panel and for receipt of the promotional device, with the flange extending from the open end for abutting with the panel outside of the opening; a first label of a size which does not extend outside of the flange and which is secured to the flange for retaining the promotional device in the basket independent of the securement of the basket and the flange to the panel; and a second label of a size larger than the flange for securement to the panel outside of the opening and the flange for retaining the tray with the promotional device retained in the basket by the first label to the panel.

2. The package of claim 1 wherein the flange is annular and abuts with the panel around the opening.

3. The package of claim 1 wherein the label includes copy printed thereon.

4. The package of claim 2 wherein the label is secured to the panel entirely around the flange.

5. The package of claim 1 further comprising, in combination: means for temporarily locking the tray to the carton for holding the tray to the carton prior to the securement of the label to the panel.

6. The package of claim 5 wherein the basket includes at least a first side wall extending from the flange; and wherein the temporary locking means comprises a friction fit between the basket and the opening, with the side wall having a cross section adjacent to the flange of a size generally equal to and for friction fit within the opening.

7. The package of claim 5 wherein the basket includes at least a first side wall extending from the flange; and wherein the temporary locking means comprises at least a first detent formed in the side wall spaced from and extending parallel to the flange a distance for receipt of the thickness of the panel and allowing movement into the opening to be positioned on the opposite side of the panel than the flange and abutting with the panel opposite the flange.

8. The package of claim 1 wherein the first and second labels are transparent.

9. The package of claim 8 wherein at least one of the labels includes copy printed thereon.

10. The package of claim 1 wherein the basket is opaque.

11. The package of claim 1 wherein the opening is in the shape of a right parallelogram and wherein the basket has the shape of a rectangular parallelepiped.

12. Method for packaging a product and a promotional device comprising the steps of: providing a carton containing the product and including at least one panel having a thickness and including an opening formed in the panel of the carton; providing a tray including a basket and a flange, with the basket having an open end and a depth substantially larger than the thickness of the panel and of a size for receipt into the opening formed in the panel and for receipt of the promotional device, with the flange extending from the open end; inserting the promotional device through the open end and into the basket; securing a first label to the flange and extending over the open end to retain the promotional device in the basket, with the first label not extending outside of the flange; inserting the basket with the promotional device retained in the basket by the first label into the opening until the flange abuts with the panel outside of the opening; and securing a second label of a size larger than the flange to the panel outside of the opening and the flange for retaining the tray to the panel.

13. The method of claim 12 wherein the inserting step includes the step of temporarily locking the tray to the carton for holding the tray to the carton prior to the securement of the second label to the panel.

14. The method of claim 12 wherein the temporarily locking step comprises the step of friction fitting the basket within the opening.

15. The method of claim 13 wherein the temporarily locking step comprises the steps of providing at least a first detent formed in the basket spaced from and extending parallel to the flange a distance for receipt of the thickness of the panel; and positioning the detent on the opposite side of the panel than the flange for abutting with the panel opposite the flange.

16. The method of claim 12 wherein the tray providing step comprises the step of providing the tray having the flange of an annular shape, with the flange abutting with the panel around the opening.

17. The method of claim 16 wherein the securing means comprises the step of securing the second label entirely around the flange.

18. The method of claim 12 wherein the first label securing step comprises the step of securing the first label having an outer periphery of a size and shape corresponding to and generally equal to the outer periphery of the flange; and wherein the second label securing step comprises the step of securing the second label having an outer periphery larger than the outer periphery of the flange at all points around the outer periphery of the flange.

19. The method of claim 18 wherein the providing step comprises the step of providing the carton having a rectangular parallelepiped shape including first and second face panels, first and second side panels, and top and bottom panels defining a hollow interior containing the product; and wherein the basket inserting step comprises the step of inserting the basket into the hollow interior of the carton through the opening.

20. The package of claim 1 wherein the flange has an outer periphery; wherein the first label has an outer periphery of a size and shape corresponding to and generally equal to the outer periphery of the flange; and wherein the second label has an outer periphery larger than the outer periphery of the flange at all points around the outer periphery of the flange.

21. The package of claim 20 wherein the carton has a rectangular parallelepiped shape including first and second face panels, first and second side panels, and top and bottom panels defining a hollow interior containing the product; with the basket being inserted into the hollow interior of the carton through the opening.

* * * * *